US009329010B1

(12) United States Patent
Moy et al.

(10) Patent No.: US 9,329,010 B1
(45) Date of Patent: May 3, 2016

(54) WATER-LINED MUNITION CONTAINER

(71) Applicants: Leon Moy, Montclair, NJ (US); Daniel Ruland, Waldwick, NJ (US); Edward Yang, Stanhope, NJ (US); Jacek Foltynski, Bayonne, NJ (US)

(72) Inventors: Leon Moy, Montclair, NJ (US); Daniel Ruland, Waldwick, NJ (US); Edward Yang, Stanhope, NJ (US); Jacek Foltynski, Bayonne, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 226 days.

(21) Appl. No.: 14/078,890

(22) Filed: Nov. 13, 2013

(51) Int. Cl.

| | |
|---|---|
| ***F42B 39/00*** | (2006.01) |
| ***F42B 39/20*** | (2006.01) |
| ***B65D 25/14*** | (2006.01) |
| ***B65D 81/38*** | (2006.01) |

(52) U.S. Cl.
CPC ..... *F42B 39/20* (2013.01); *B65D 25/14* (2013.01); *B65D 81/382* (2013.01)

(58) Field of Classification Search
CPC ..... F42B 39/20; F42B 39/14; F42B 39/16; B65D 25/14; B65D 81/382
USPC ..... 206/3; 89/36.01, 36.07, 36.11, 36.12; 73/167; 102/481, 493
See application file for complete search history.

(56) References Cited

U.S. PATENT DOCUMENTS

| | | | | | |
|---|---|---|---|---|---|
| 810,060 | A * | 1/1906 | Leathers | F42B 39/00 | 109/80 |
| 2,420,663 | A * | 5/1947 | Heath | F42B 39/16 | 206/3 |
| 2,558,726 | A * | 7/1951 | Barker | F41H 9/00 | 102/364 |
| 4,010,690 | A * | 3/1977 | Cocozella | F42B 39/18 | 102/282 |
| 4,037,536 | A * | 7/1977 | Griffith | F42B 3/00 | 102/331 |
| 4,041,869 | A * | 8/1977 | San Miguel | F02K 9/346 | 102/481 |
| 4,084,512 | A * | 4/1978 | San Miguel | F02K 9/38 | 102/282 |
| 4,423,683 | A * | 1/1984 | Telmo | F42B 39/20 | 102/481 |
| 4,671,177 | A * | 6/1987 | Mayville | F42C 19/0815 | 102/204 |
| 4,833,967 | A * | 5/1989 | Kornhauser | F41H 5/02 | 206/3 |
| 5,036,658 | A * | 8/1991 | Tate | F42B 39/20 | 60/253 |
| 5,038,686 | A * | 8/1991 | Zulkoski | F42B 39/20 | 102/481 |
| 5,170,007 | A * | 12/1992 | Figge, Sr. | F02K 9/34 | 102/481 |
| 8,381,657 | B1 * | 2/2013 | Hooke | F42B 8/26 | 102/481 |

* cited by examiner

*Primary Examiner* — J. Gregory Pickett
*Assistant Examiner* — Jennifer N Zettl
(74) *Attorney, Agent, or Firm* — John P. DiScala

(57) ABSTRACT

A storage apparatus for a munition that contains energetic material uses a water-filled liner to absorb heat applied from the exterior of the storage apparatus. The liner is disposed between the munition and a metal storage container. The liner has segregated compartments which release water into either the storage container or the liner itself. The released water boils and forms steam. A spiral-shaped steam conduit is formed in either the wall of the storage container or in the liner itself. The steam conduit directs the steam away from the munition. The metal storage container includes a pressure relief valve to release the steam pressure. The storage apparatus delays the detonation of the energetic material in the munition.

20 Claims, 6 Drawing Sheets

WATER-LINED MUNITION CONTAINER

STATEMENT OF GOVERNMENT INTEREST

The inventions described herein may be manufactured, used and licensed by or for the United States Government.

BACKGROUND OF THE INVENTION

The invention relates in general to munitions and in particular to compliance with Insensitive Munitions (IM) standards. IM standards require that, to the extent practicable, munitions are safe when subjected to unplanned stimuli. The Fast Cook Off (FCO) test is used to simulate a situation wherein munitions are exposed to a fire. In FCO, munitions are engulfed in a flame of at least 1700° C. until the munition reacts. It is desirable for the reaction to be limited to no more than burning (Type 5 IM reaction). A detonation type of reaction (Type 1 IM reaction) is to be avoided. During a FCO test, munitions with no IM features typically demonstrate a Type 1 IM detonation in less than ten minutes.

In some cases, the IM features of a munition require a slow heating to function properly. In other cases, where a complete IM solution is not viable, an improvement such as delaying the onset of the Type 1 IM reaction is desirable.

Known munition and ammo containers have several forms, including boxes and tubes. Some of these containers have IM features for the venting of gases or for insulating the munition. The venting of gases may increase the delay time to detonation. Insulating a munition, by itself, has a minimal effect on the delay time to detonation. One known munition container is made of a composite glass-reinforced resin with meltable salts. As the salts melt, they absorb heat. However, resin or plastic containers are often not suitable for munitions because the containers do not meet leak test standards after the containers are thermally cycled. Some commercial fireproof safes and fireproof doors use a layer of felt that is impregnated with a water-based hydrogel as a means to mitigate heat damage.

IM venting is not feasible for some munitions. For example, the AT4 single-shot recoilless weapon is stored with the propellant in the weapon. The propellant in the AT4 is contained in its barrel, between the warhead and a counter mass. Without venting and when exposed to conditions like the FCO test, munitions such as the AT4 will detonate quickly. There is not enough time prior to detonation to evacuate or rescue nearby personnel. In some munitions, even if IM vents are present, the heating may occur distal from the IM vent and the munition may detonate before the IM vent has activated. The heating rate in situations like the FCO test is so rapid that there may not be enough time for the IM features to function prior to detonation.

A need exists for an apparatus and method for delaying the detonation time of munitions exposed to a FCO test.

SUMMARY OF INVENTION

One aspect of the invention is an apparatus including a closed, metal container having a central longitudinal axis. A munition is disposed in the container. The munition contains energetic material and has a central longitudinal axis that is generally parallel to the central longitudinal axis of the container. A pressure relief valve is disposed in a wall of the container for relieving steam pressure in the container. A heat-absorbing liner is disposed between an interior surface of the container and the munition. The liner has a central longitudinal axis that is generally parallel to the central longitudinal axis of the munition. The liner extends around a perimeter of the munition and extends axially along at least a portion of the munition.

The liner has an inner layer facing the munition and an outer layer facing the interior of the container. The inner and the outer layers define a plurality of segregated compartments. Each compartment contains water. The apparatus includes a fluid conduit having a spiral-shaped cross-section and a central longitudinal axis that is generally parallel to the central longitudinal axis of the munition. The munition is disposed internal to the fluid conduit.

Preferably, the central longitudinal axes of the container, the munition, the liner and the fluid conduit are all generally horizontal.

The plurality of segregated compartments may contain hydrogel and/or a wicking material.

In one embodiment, the wall of the container includes the spiral-shaped fluid conduit.

In another embodiment, the liner includes the spiral-shaped fluid conduit. At least one of the inner and outer layers of the liner may include a peripheral metal foil layer. The spiral-shaped conduit may be defined by adjacent wraps of the liner around the munition.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel apparatus for storing a munition uses water or water compositions, such as hydrogel, to absorb heat. The heat source is external to the stored munition. Water has a heat of vaporization of 2257 joules per gram. The heat of vaporization of water is 540 times greater than the heat needed to raise the temperature of one gram of water 1 degree C. Water maintains its boiling temperature until it is evaporated.

Figure 1:
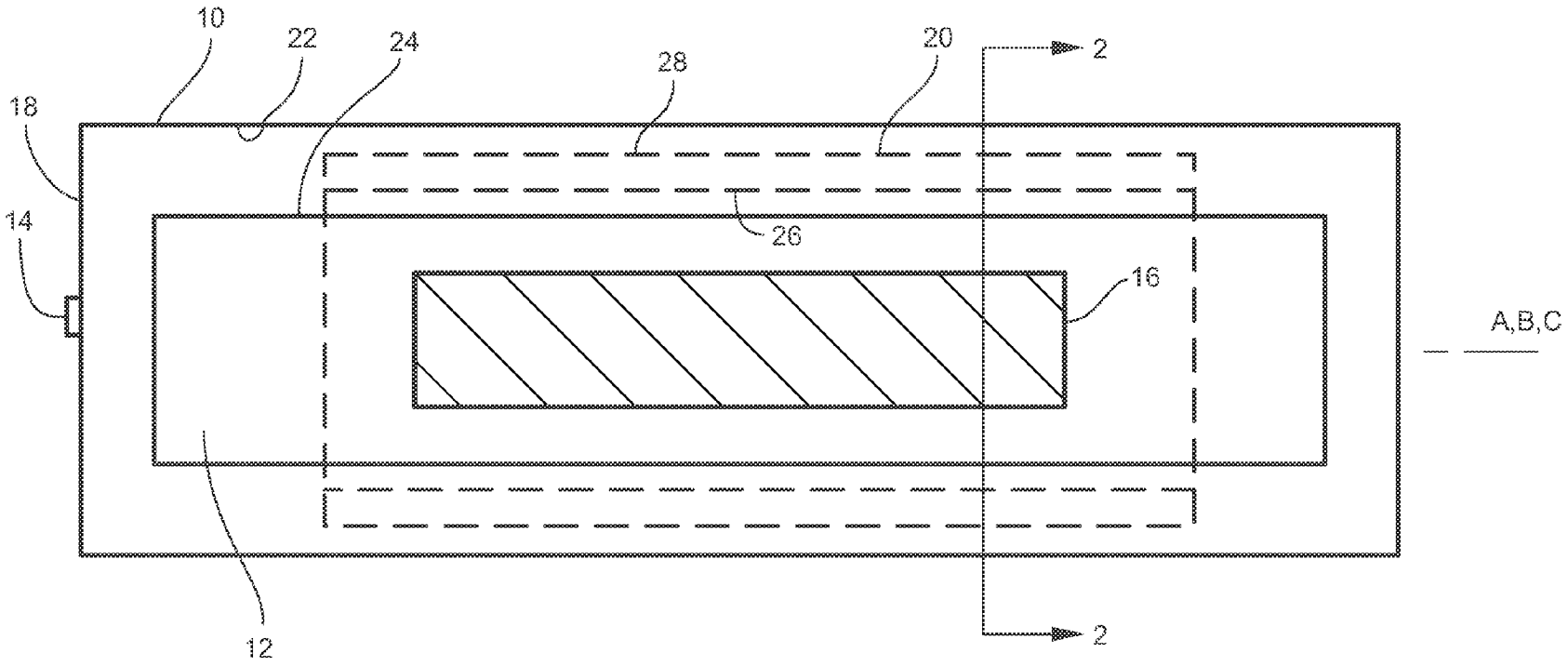
FIG. 1 is a cutaway schematic side view of an embodiment of an apparatus for storing a munition.
Figure 2:
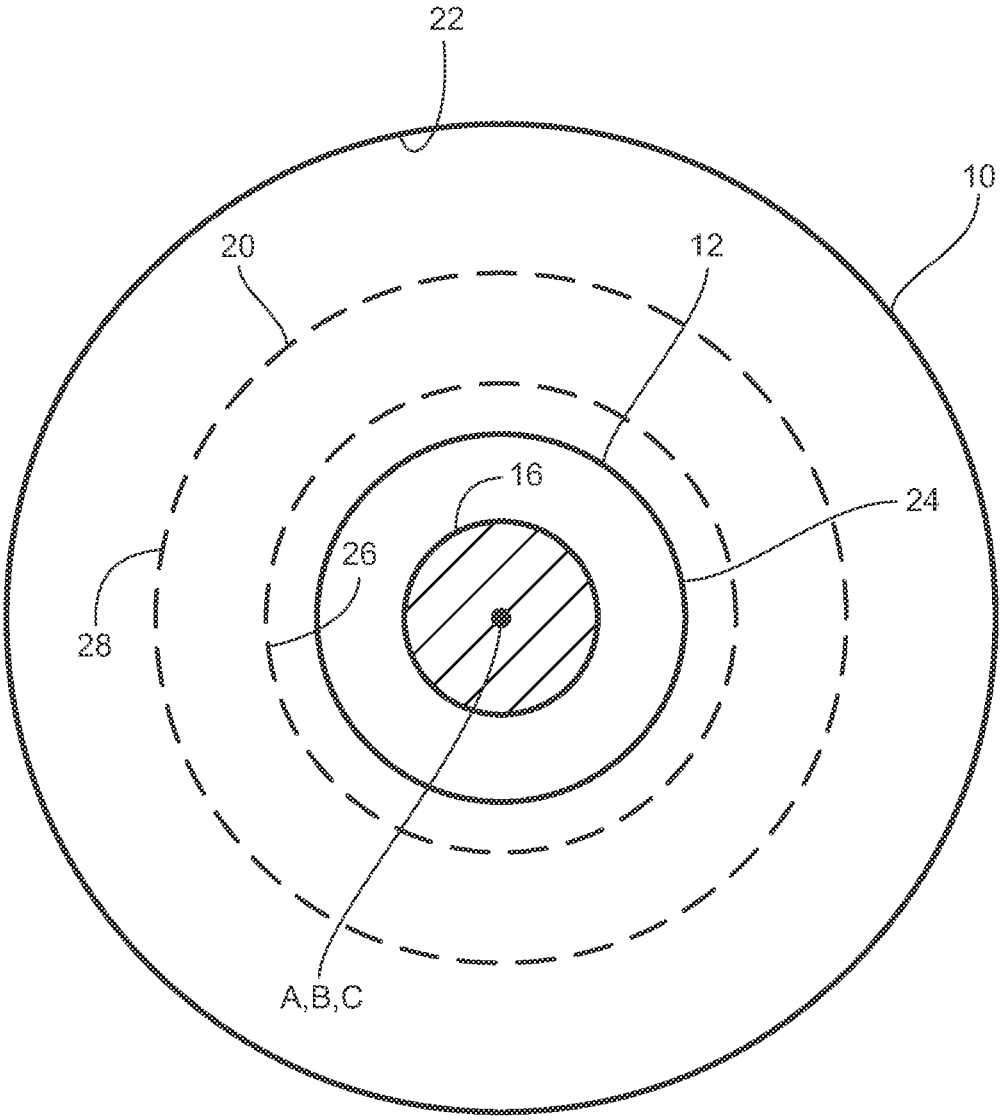
FIG. 2 is a sectional view along the line 2-2 of FIG. 1.

FIG. 1 is a cutaway schematic side view of one embodiment of a munition container 10 and FIG. 2 is a sectional view of FIG. 1. Container 10 is a closed container having a central longitudinal axis A. Container 10 is made of metal, for example, steel. A munition 12 contains energetic material 16 and is stored in container 10. Munition 12 has a central longitudinal axis B. Axis B of munition 12 is generally parallel to axis A of container 10. A pressure relief valve 14 is disposed in a wall 18 of container 10 for relieving steam pressure in container 10.

A heat-absorbing liner 20, shown in dashed lines in FIGS. 1 and 2, is disposed between an interior surface 22 of container 10 and munition 12. Liner 20 has a central longitudinal axis C that is generally parallel to axis B of munition 12. Liner 20 extends around the entire perimeter 24 of munition 12 and extends axially along at least a portion of munition 12. Liner 20 may extend around the perimeter 24 of munition 12 multiple times. Liner 20 has an inner layer 26 that faces munition 12 and an outer layer 28 that faces interior surface 22 of container 10. In FIG. 2, container 10, munition 12 and liner 20 are shown as cylindrical shapes for clarity. However, container 10, munition 12 and liner 20 may have other shapes and each need not be the same shape as the other. It is preferred that axes A, B and C are all generally horizontal.

Figure 4:
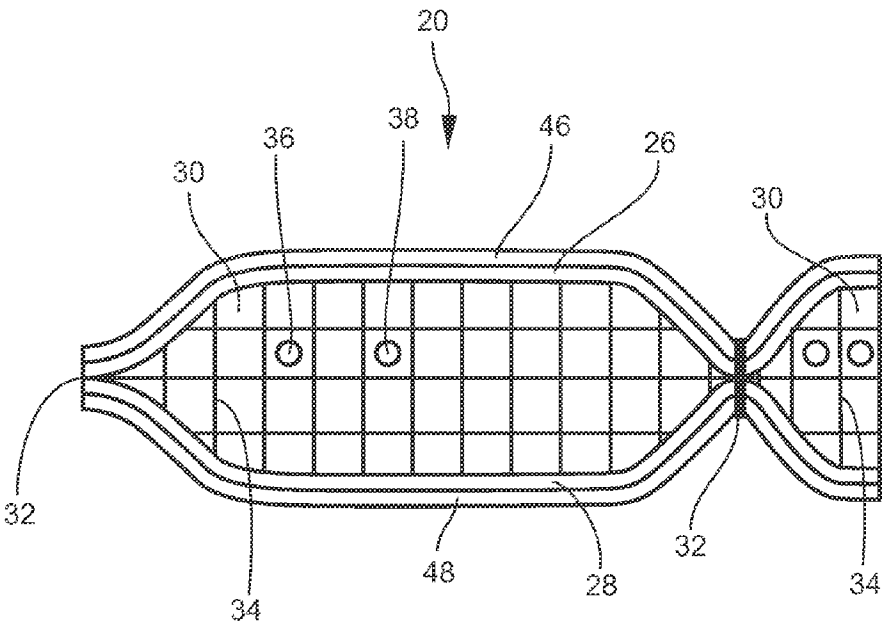
FIG. 4 is a sectional view along the line 4-4 of FIG. 3.
Figure 3:
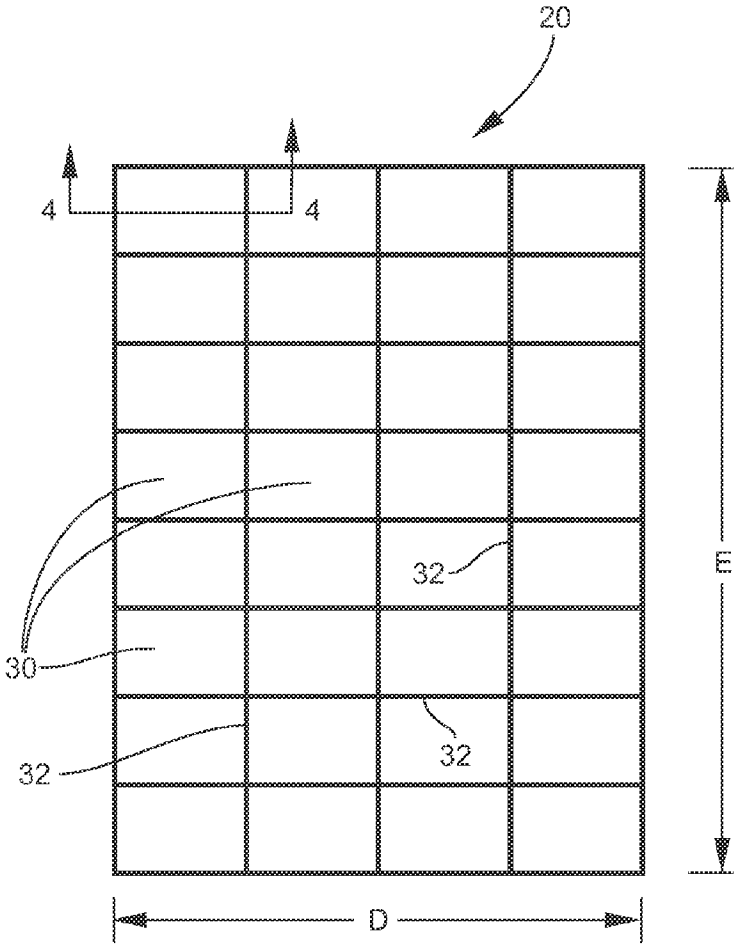
FIG. 3 is a schematic front view of a flattened liner for a munitions container.

FIG. 3 is a schematic front view of liner 20 in an unrolled or flattened position. FIG. 4 is a sectional view along the line 4-4 of FIG. 3. In the flattened position, liner 20 is generally rectangular with a dimension D along its axis C and a dimension E that is orthogonal to dimension D. Dimensions D and E may be selected as needed for a particular munition. Inner layer 26 and outer layer 28 of liner 20 form a plurality of segregated compartments 30 with seams 32, such as the array of rows and columns of compartments 30 shown in FIG. 3. The number of rows and columns of compartments 30 may be varied. The size of the compartments 30 may be varied. Each compartment 30 contains at least water 36. Preferably, each compartment 30 contains a water-based gel such as a hydrogel 38. Each compartment 30 may also contain wicking material 34. Liner 20 may be made of, for example, two sheets of plastic that are heat-sealed to form seams 32 and compartments 30.

As liner 20 absorbs heat generated external to container 10, one or more compartments 30 may burst or fail. The water 36 or hydrogel 38 from the burst compartments will collect in the bottom of liner 20 and/or in the bottom of container 10. As the water 36 or hydrogel 38 in the bottom of liner 20 and/or container 10 boils, steam is produced. Thermal protection for munition 12 occurs by directing the steam that is produced through a fluid conduit having a spiral-shaped cross-section. The munition 12 is disposed internal to the spiral-shaped fluid conduit.

Figure 5:
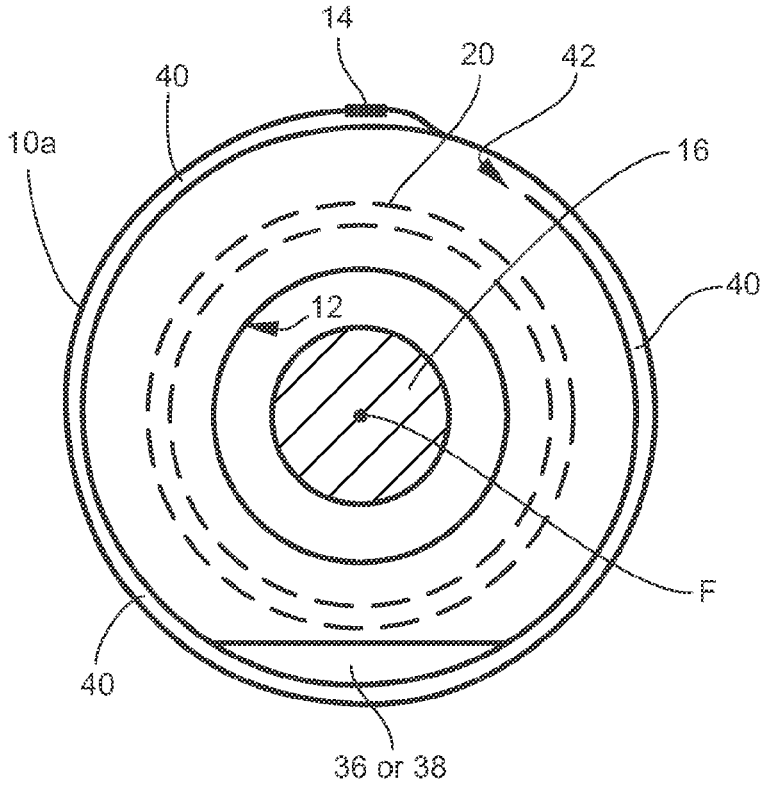
FIG. 5 is a schematic transverse sectional view of a munitions container having a spiral-shaped fluid conduit formed in its wall.

FIG. 5 is a schematic transverse sectional view of one embodiment of a spiral-shaped fluid conduit 40 formed by the double-wall of container 10*a*. Conduit 40 has a central longitudinal axis F that is generally parallel to axis B of munition 12. Munition 12 and liner 20 are disposed internal to spiral-shaped fluid conduit 40. The entrance 42 to conduit 40 is preferably located vertically at least as high as axis F of conduit 40. Water 36 or hydrogel 38 from burst compartments in liner 20 collects in the bottom of container 10*a*, boils, and enters entrance 42 of conduit 40. The steam flowing through spiral-shaped conduit 40 absorbs heat being applied to container 10*a* from the external environment outside container 10*a* and carries the heat away from munition 12. When the steam pressure in conduit 40 is high enough, the steam will exit container 10*a* via relief valve 14.

Figure 6:
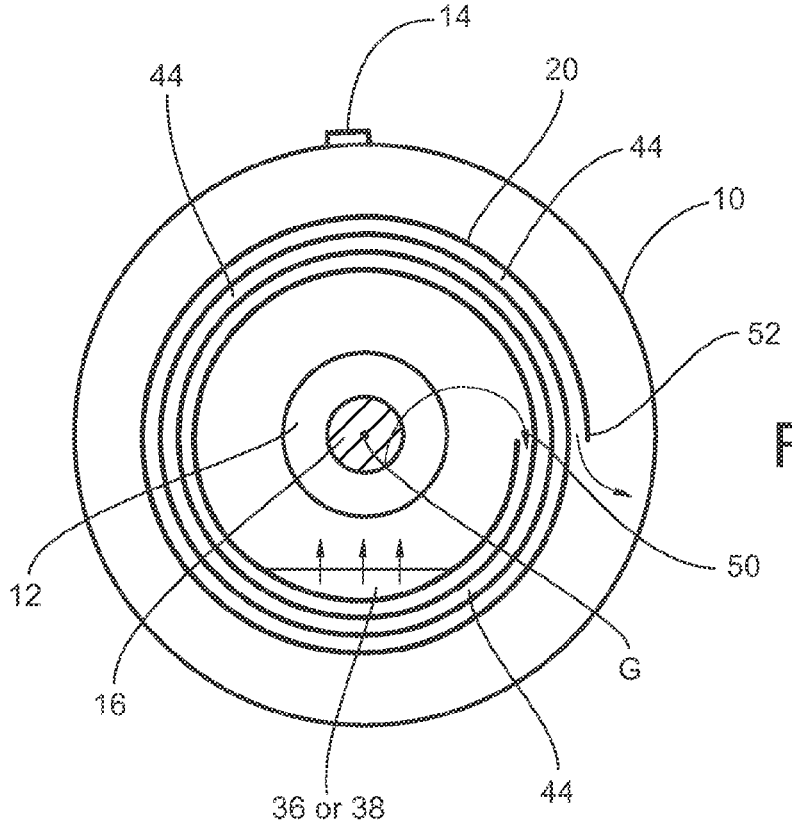
FIG. 6 is a schematic transverse sectional view of a liner having a spiral-shaped fluid conduit.

FIG. 6 is a schematic transverse sectional view of another embodiment of a spiral-shaped fluid conduit 44. Conduit 44 is formed by multiple wraps of liner 20 around munition 12. Conduit 44 has a central longitudinal axis G that is generally parallel to axis B of munition 12. When liner 20 is used as conduit 44, one or both of the inner layer 26 (FIG. 4) and outer layer 28 of liner 20 include a peripheral foil layer or foil coating 46 and/or 48, respectively. The foil layer(s) 46, 48 contain and guide the hot steam. Foil layer(s) 46, 48 on adjacent wraps of liner 20 from spiral-shaped conduit 44. Foil layers 46, 48 may be made of a metal, for example, aluminum.

The entrance 50 to conduit 44 is preferably located vertically at least as high as the axis G of conduit 44. Water 36 or hydrogel 38 from burst compartments in liner 20 collects in the bottom of liner 20, boils, and enters entrance 50 of conduit 44. The steam flowing in spiral-shaped conduit 44 absorbs heat being applied to container 10 from the external environment outside container 10. The steam leaves conduit 44 at conduit exit 52 and enters container 10. When the steam pressure in container 10 is high enough, the steam will exit container 10 via relief valve 14.

Figure 7:
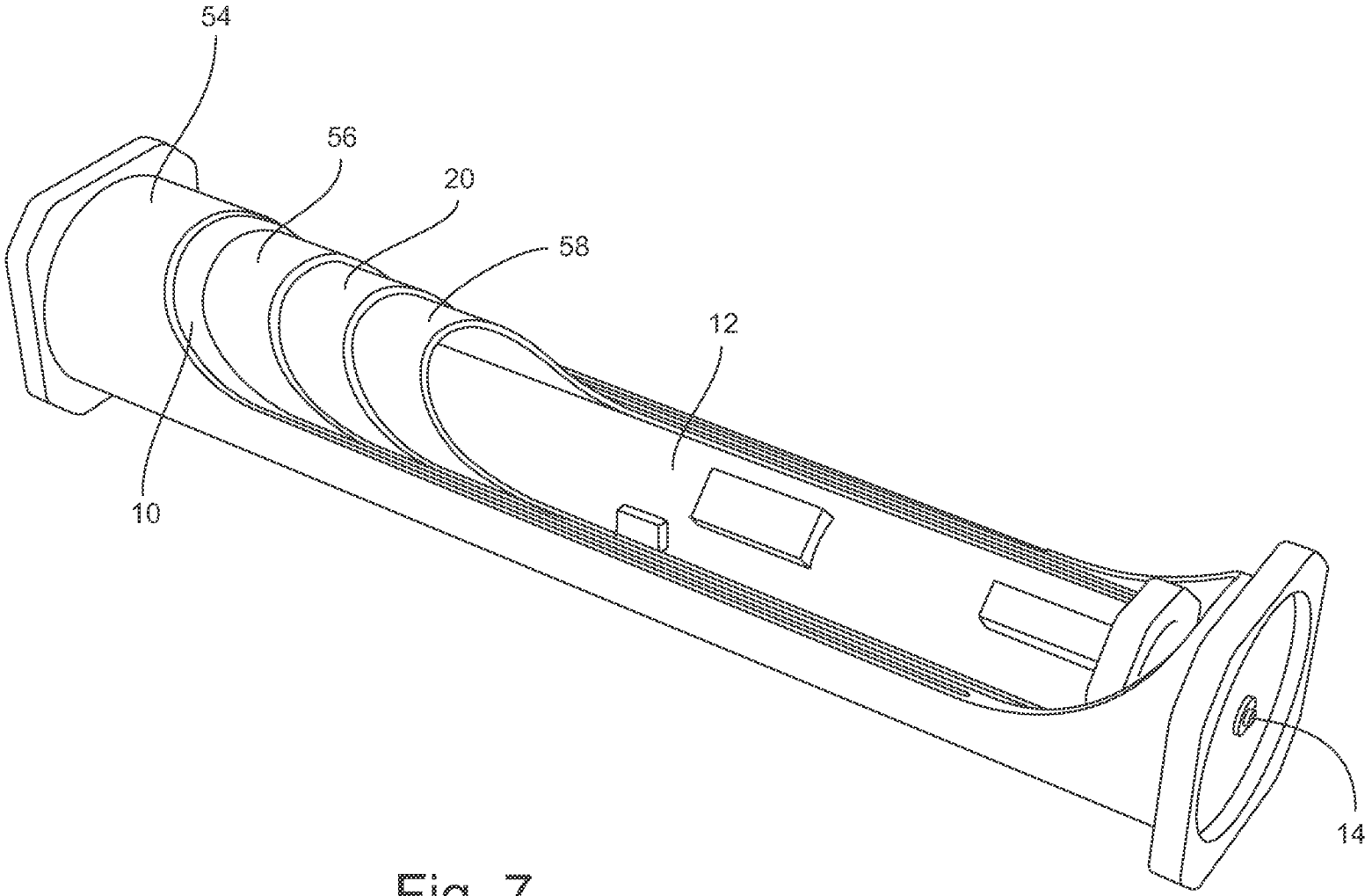
FIG. 7 is a partially cutaway perspective view of an embodiment of an apparatus for storing a munition.

FIG. 7 is a partially cutaway schematic perspective view of one embodiment of an apparatus for storing munition 12. A layer of heat insulating material 54 may be wrapped around the exterior of metal container 10. The heat insulating material 54 may be, for example, fiberglass. A layer of wicking material 56 may be placed adjacent to the interior surface of container 10. Wicking material 56 may be, for example, felt. Multiple wraps of liner 20 with foil layer(s) 46, 48 (FIG. 4) are disposed around munition 12 and adjacent to wicking material 56. Protective dunnage 58 may be used between liner 20 and munition 12. Dunnage 58 may be a packing material, for example, cardboard.

TEST RESULTS

A heating test was conducted on an AT4 single-shot recoilless weapon loaded with its propellant. To establish a baseline measurement, an AT4 weapon was placed in a wooden container without a liner 20 and heated. The AT4 weapon detonated in about 7 minutes. Another baseline measurement was made using computer simulation to calculate the time required to detonate the AT4 when placed in a steel container. In the simulation of the steel container, the time to detonation was also about 7 minutes. The reaction time of 7 minutes is, from the perspective of munitions in general, exceptionally long because the propellant in the AT4 is insulated by a barrel. Most munitions have a thin-walled cartridge case and, during a FCO test, will react in a matter of seconds. Such a short time period does not enable another type of IM feature to activate.

A liner 20 was constructed using two sheets of plastic that were heat-sealed to form compartments 30 and water was placed in the compartments 30. A vapor barrier sheet having a foil layer was placed on the exterior of one of the plastic sheets of the liner 20. The liner 20 was wrapped around the AT4 weapon three times and secured to the AT4 weapon with duct tape. The AT4 weapon and liner 20 were placed in a PA116 steel container 10 with a vent 14. The test time was limited to about 22 minutes. The flame temperature fluctuated and averaged about 1700 degrees F.

Figure 8:
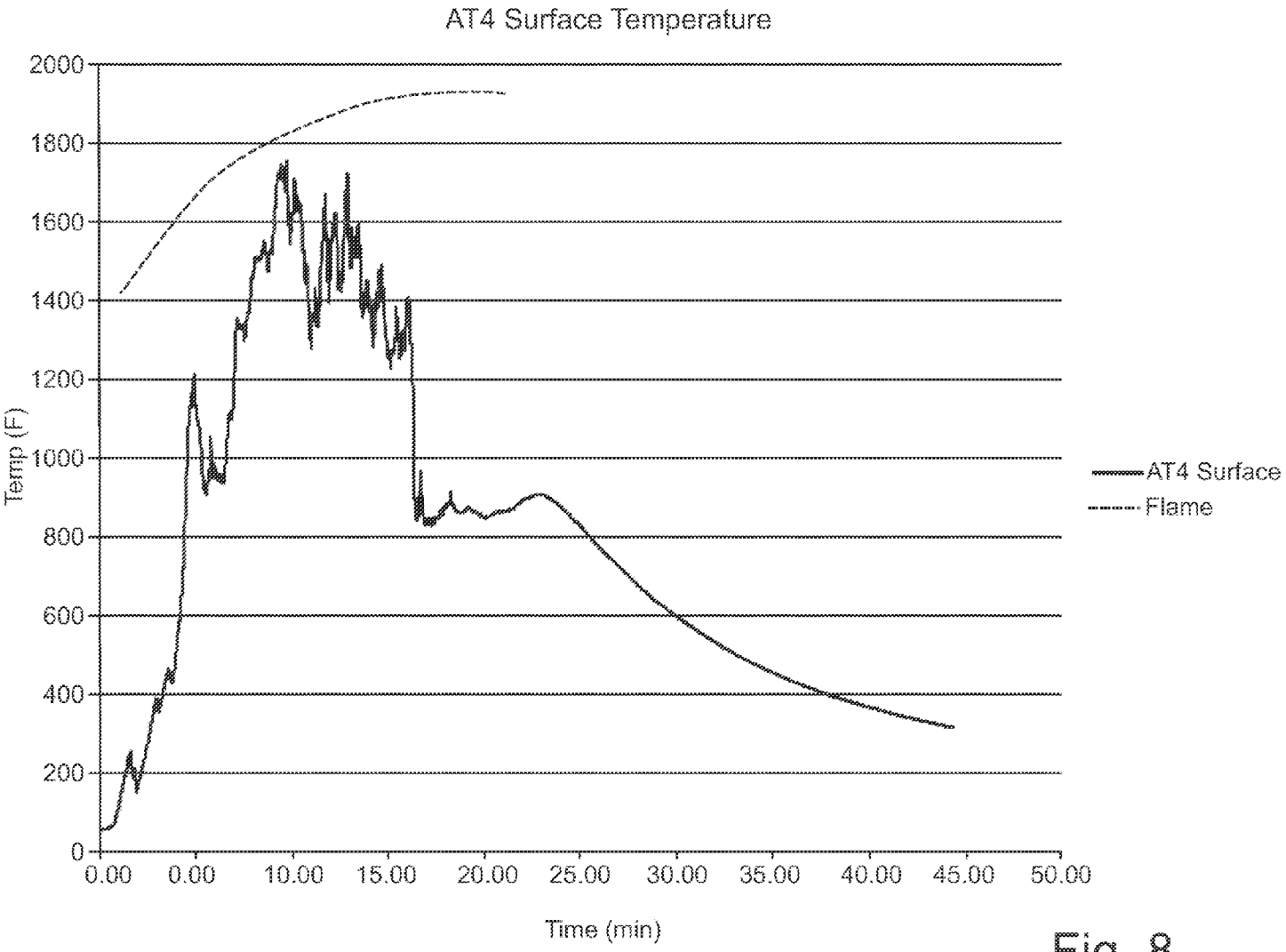
FIG. 8 is a graph of temperature as a function of time from a test of one embodiment of an apparatus for storing a munition.

The AT4 weapon with the liner 20 did not react after a burn time of 22 minutes. The apparatus was examined after the burn test and water was still retained in the spiral-shaped conduit 44. The surface of the AT4 weapon under the liner 20, including plastic parts of the AT4, decals on the AT4, and the duct tape, were all intact. FIG. 8 is a graph of the temperature on the top surface of the AT4 (inside the conduit 44) as a function of time. Because water from the burst compartments 30 pools at the bottom of liner 20, the cooling at the top of the AT4, as shown in FIG. 8, is from the steam in conduit 44.

While the invention has been described with reference to certain embodiments, numerous changes, alterations and modifications to the described embodiments are possible without departing from the spirit and scope of the invention as defined in the appended claims, and equivalents thereof.

What is claimed is:

1. An apparatus, comprising;

a closed, metal container having a central longitudinal axis;

a munition containing energetic material and having a central longitudinal axis, the munition being disposed in the container with the central longitudinal axis of the munition generally parallel to the central longitudinal axis of the container;

a pressure relief valve disposed in a wall of the container for relieving steam pressure in the container;

a heat-absorbing liner disposed between an interior surface of the container and the munition, the liner having a central longitudinal axis generally parallel to the central longitudinal axis of the munition, the liner extending around a perimeter of the munition and extending axially along at least a portion of the munition;

the liner having an inner layer facing the munition and an outer layer facing the interior of the container, the inner and the outer layers defining a plurality of segregated compartments wherein each compartment contains water; and a fluid conduit having a spiral-shaped cross-section and a central longitudinal axis that is generally parallel to the central longitudinal axis of the munition, the munition being disposed internal to the fluid conduit.

2. The apparatus of claim 1, wherein the central longitudinal axes of the container, the munition, the liner and the fluid conduit are all generally horizontal.

3. The apparatus of claim 1, wherein each of the plurality of segregated compartments contains hydrogel.

4. The apparatus of claim 1, wherein each of the plurality of segregated compartments contains a wicking material.

5. The apparatus of claim 1, wherein a layer of heat insulating material is disposed on an exterior surface of the container.

6. The apparatus of claim 1, wherein a layer of wicking material is adjacent to the interior surface of the container.

7. The apparatus of claim 1, wherein the wall of the container includes the spiral-shaped fluid conduit.

8. The apparatus of claim 1, wherein the liner includes the spiral-shaped fluid conduit.

9. The apparatus of claim 8, wherein the outer layer of the liner includes a peripheral metal foil layer.

10. The apparatus of claim 8, wherein the inner layer of the liner includes a peripheral metal foil layer.

11. The apparatus of claim 8, wherein both the inner and outer layers of the liner include a peripheral metal foil layer.

12. The apparatus of claim 11, wherein the spiral-shaped conduit is defined by adjacent wraps of the liner around the munition.

13. An apparatus, comprising;

a closed, metal container having a central longitudinal axis;

a munition containing energetic material and having a central longitudinal axis, the munition being disposed in the container with the central longitudinal axis of the munition generally parallel to the central longitudinal axis of the container;

a pressure relief valve disposed in a wall of the container for relieving steam pressure in the container;

a heat-absorbing liner disposed between an interior surface of the container and the munition, the liner having a central longitudinal axis generally parallel to the central longitudinal axis of the munition, the liner extending around a perimeter of the munition and extending axially along at least a portion of the munition;

the liner having an inner layer facing the munition and an outer layer facing the interior of the container, the inner and the outer layers defining a plurality of segregated compartments wherein each compartment contains water; and a fluid conduit formed in the wall of the container, the fluid conduit having a spiral-shaped cross-section and a central longitudinal axis that is generally parallel to the central longitudinal axis of the munition, the munition being disposed internal to the fluid conduit;

wherein the central longitudinal axes of the container, the munition, the liner and the fluid conduit are all generally horizontal and an entrance to the fluid conduit is located vertically at least as high as the axis of the fluid conduit.

14. The apparatus of claim 13, wherein each of the plurality of segregated compartments contains hydrogel.

15. The apparatus of claim 13, wherein each of the plurality of segregated compartments contains a wicking material.

16. The apparatus of claim 13, wherein a layer of heat insulating material is disposed on an exterior surface of the container.

17. The apparatus of claim 13, wherein a layer of wicking material is adjacent to the interior surface of the container.

18. An apparatus, comprising;

a closed, metal container having a central longitudinal axis;

a munition containing energetic material and having a central longitudinal axis, the munition being disposed in the container with the central longitudinal axis of the munition generally parallel to the central longitudinal axis of the container;

a pressure relief valve disposed in a wall of the container for relieving steam pressure in the container;

a heat-absorbing liner disposed between an interior surface of the container and the munition, the liner having a central longitudinal axis generally parallel to the central longitudinal axis of the munition, the liner encircling a perimeter of the munition more than once and extending axially along at least a portion of the munition;

the liner having an inner layer facing the munition and an outer layer facing the interior of the container, the inner and the outer layers defining a plurality of segregated compartments wherein each compartment contains water; and at least one of the inner layer and the outer layer including a peripheral metal foil layer wherein adjacent wraps of the liner around the munition form a fluid conduit having a spiral-shaped cross-section and a central longitudinal axis that is generally parallel to the central longitudinal axis of the munition;

wherein the central longitudinal axes of the container, the munition, the liner and the fluid conduit are all generally horizontal and an entrance to the fluid conduit is located vertically at least as high as the axis of the fluid conduit.

19. The apparatus of claim 18, wherein each of the plurality of segregated compartments contains hydrogel.

20. The apparatus of claim 18, wherein each of the plurality of segregated compartments contains a wicking material.

* * * * *